US006554596B1

(12) United States Patent
Patterson et al.

(10) Patent No.: US 6,554,596 B1
(45) Date of Patent: Apr. 29, 2003

(54) FLUID TURBINE DEVICE

(76) Inventors: David C. Patterson, RR# 6 Lot 12 conc. 3, Beckwith Twnsp., 1865 Richmond Road, Smith Falls, Ontario (CA), K7A 457; Albert Patterson, RR # 4 West Lorne, Ontario (CA), N0L 2P0

( * ) Notice: Subject to any disclaimer, the term of this patent is extended or adjusted under 35 U.S.C. 154(b) by 0 days.

(21) Appl. No.: 09/973,782

(22) Filed: Oct. 11, 2001

(51) Int. Cl.[7] ..... F01C 1/00

(52) U.S. Cl. ..... 418/260; 418/267; 418/268; 418/259

(58) Field of Search ..... 418/260, 268, 418/259

(56) References Cited

U.S. PATENT DOCUMENTS

| | | | | | |
|---|---|---|---|---|---|
| 232,559 | A | * | 9/1880 | Smith | 418/259 |
| 643,432 | A | * | 2/1900 | Goodwin et al. | 418/260 |
| 1,023,872 | A | * | 4/1912 | Pearson | 418/260 |
| 1,042,595 | A | * | 10/1912 | Pearson | 418/260 |
| 2,098,244 | A | | 11/1937 | Hopfensberger | |
| 2,310,816 | A | | 2/1943 | Taylor | |
| 4,468,964 | A | * | 9/1984 | Groeneweg | 418/260 |
| 4,551,896 | A | * | 11/1985 | Sakamaki et al. | 29/888.025 |
| 4,646,568 | A | * | 3/1987 | Lew | 418/268 |

FOREIGN PATENT DOCUMENTS

| | | |
|---|---|---|
| CA | 32552 | 10/1889 |
| CA | 115442 | 12/1908 |
| CA | 202671 | 8/1920 |
| CA | 203163 | 8/1920 |
| JP | 61152987 A * | 7/1986 ..... F04C/18/344 |
| JP | 03206381 A * | 9/1991 ..... F04C/2/344 |

* cited by examiner

*Primary Examiner*—Thomas Denion
*Assistant Examiner*—Theresa Trieu

(57) ABSTRACT

A rotor device is provided for converting the energy of a flowing fluid, such as air or water, into mechanical energy. The device comprises a rotor mounted within a housing. Two or more vanes having inner and outer ends extend parallel to the axis of the rotor and are movable inwardly and outwardly between retracted and extended positions radially with respect to the cylindrical side wall of the rotor within slots therein The vanes have side shoulders which slide in corresponding guide slots in the end of the rotor body. The outer ends of the vanes are positioned adjacent to the inner wall of the housing and the vanes are spaced preferably equally from adjacent vanes about the rotor such that there is always at least one vane positioned between fluid inlet and outlet ports of the housing. Means are provided to move each of the vanes radially within its associated slot between an extended position and a fully retracted position so that the outer extremity of each vane is positioned adjacent a corresponding portion of the inner wall of the housing. The rotor, housing and vanes are constructed so that, during operation of the device, fluid entering the housing drives the rotor and is carried by the rotor in compartments formed between adjacent vanes and, opposing walls of the housing and rotor, until the adjacent vanes encompass the outlet port whereby the fluid is allowed to escape. Such a device provides a novel and efficient structure having application, for example, as a fluid motor such as an air motor, pump, metering device or turbine for harnessing power.

5 Claims, 3 Drawing Sheets

FLUID TURBINE DEVICE

BACKGROUND OF THE INVENTION

The present invention relates to a rotor device for converting the energy of a flowing fluid into mechanical energy, and more particularly to a housed rotor having reciprocating vanes. Many and diverse uses are seen for the device of the present invention, including use as a fluid motor such as an air motor, metering device, pump and turbine for harnessing power from a flowing fluid.

Rotary motors which convert the energy of a flowing fluid into mechanical, rotational energy are well known in the art. See for example, Canadian Patent No. 203,163 issued Aug. 17, 1920 of Fritz-Enssle; Canadian Patent No. 32,552 of Brown issued Oct. 3, 1889; Canada Patent No. 115,443 of Van Scoter et al issued Dec. 8, 1908 and U.S. Pat. No. 2,310,816 of Taylor issued Feb. 9, 1943. Most of these devices operate by passing a fluid such as water along one side of a rotor, against the faces of blades which, on the opposite side, pivot to align themselves in the direction of flow so that they may return to initial position against the flow of fluid.

Hopfensberger U.S. Pat. No. 2,098,244 issued Nov. 9, 1937 describes a rotating machine containing a rotor surrounded by a cylindrical drum eccentrically mounted with respect to the rotor. Rotational movement of the rotor is translated to the drum by means of frictional forces exerted on the latter by walls which forms cells of the rotor. In one embodiment, sliding gates form the cells of the rotor, and their ends, bearing against the inner surface of the cylindrical drum, cause the latter to rotate. Such a device however is not intended for, and has no application to, the conversion of energy of a flowing fluid into mechanical energy.

Rotary motors which convert the energy of a flowing fluid into mechanical rotational energy are well known in the art. See for example, Canadian Patent No. 203,163 issued Aug. 17, 1920 of Fritz-Enssle; Canadian Patent No. 32,552 of Brown issued Oct. 3, 1889; Canadian Patent No. 115,442 of Van Scoter et al issued Dec. 8, 1908 and U.S. Pat. No. 2,310,816 of Taylor issued Feb. 9, 1943. Most of these devices operated by passing a fluid such as water along one side of a rotor against the faces of blades which, on the opposite side, pivot to align themselves in the direction of flow so that they may return to initial position against the flow of fluid.

It is an object of the present invention to provide a novel device for converting the energy of a flowing fluid into mechanical energy. It is a further object of the present invention to provide a device which has a minimum of moving parts and which will efficiently lead to the required conversion.

SUMMARY OF THE INVENTION

In accordance with the present invention there is provided a rotor device for converting the energy of a flowing fluid, such as air or water, into mechanical energy. The device comprises a rotor having ends and a cylindrical sidewall, and a housing encasing the rotor. A rotor disk is provided at each end of the rotor to rotate therewith. The housing has interior end walls confronting the rotor ends, interior sidewalls and fluid inlet and fluid outlet ports. A first portion of the interior side wall of the housing is cylindrical and curved with constant radius over an angle of approximately 180°. This portion of the interior side wall is spaced a constant distance from corresponding portions of the wall of the rotor. A second portion of the interior side wall of the housing continues from the extremities of the first portion and has a curvature of greater radius. The wall of the rotor meets the interior wall of the housing at a point between inlet and outlet ports about midway on this second portion. The inlet and outlet ports are located in this second portion of the interior side wall of the housing. Two or more vanes having inner and outer ends extend parallel to the axis of the rotor and are movable radially inwardly and outwardly between retracted and extended positions with respect to the cylindrical side wall of the rotor within slots therein the vanes have side shoulders which slide in corresponding guide slots in the rotor disks. The outer ends of the vanes are positioned adjacent the inner wall of the housing and the vanes are spaced preferably equally from adjacent vanes about the rotor such that there is always at least one vane positioned between the inlet and outlet ports. Means are provided to move each of the vanes radially within its associated slots between an extended position and a fully withdrawn position so that the outer extremity of each vane is positioned adjacent a corresponding portion of the inner wall of the housing. The rotor, housing and vanes are constructed so that, during operation of the device, fluid entering the housing drives the rotor and is carried by the rotor in compartments formed between adjacent vanes and, opposing walls of the housing and rotor, and the rotor itself, until the adjacent vanes encompass the outlet port whereby the fluid is allowed to escape.

In a preferred embodiment of the invention, the means to move the vanes comprises a cam surface means which bears against the inner ends of the vanes to extend them, cooperating with the inner wall of the housing which bears against the outer ends of the vanes to push the vanes inwardly into withdrawn position. The distance between corresponding facing portions on the cam surface and inner wall of the housing in this embodiment are constant about the device.

Also, an appropriate sealing means is provided in the inner wall of the housing, between the inlet and outlet ports, in the vicinity of the point of the contact between the wall of the rotor and inner wall of the housing, whereby leakage of fluid from one side of this point to the other is minimized.

In an alternative embodiment of the present invention there is provided a rotor having ends and a cylindrical side wall, a housing encasing the rotor and having corresponding ends and a cylindrical side wall, and two or more curved vanes having inner and outer ends. The inner ends of the vanes are pivotally secured to the side wall of the rotor, each vane pivoting between a retracted position adjacent the rotor side wall and an extended position at which its outer end is immediately adjacent the interior side wall housing. The vanes are spaced from adjacent vanes about the rotor such that there is always at least one vane positioned between inlet and outlet ports. The rotor, housing and vanes are constructed so that, during operation of the device, fluid entering the housing moves a corresponding vane from retracted to extended position and is carried by the rotor in compartments thus formed between adjacent vanes, opposing walls of the housing and rotor, and the ends of the rotor, until the adjacent vanes encompass the outlet port whereby the fluid is allowed to escape following which the side wall of the housing causes the vane to close.

The rotor device according to the present invention has application as a turbine for harnessing the power of a flowing fluid, as a pump or as a device for metering volume of fluid flow through a system. Other uses will be apparent to one skilled in the art.

The device according to the present invention provides a smooth operation and is efficient in that it rotates under full power, with the vanes in their fully extended position over a half of a revolution. The construction of the device readily lends itself to appropriate sealing between adjacent compartments and in the vicinity of the point of contact between the side wall of the rotor and the interior side wall of the housing. The device may be used with fluids such as water, oil or the like, or gases such as air.

Again, because of its construction, the device, when provided with means to record the number of rotations of the rotor, can thereby be adapted for use as a meter. This construction enables very accurate metering of volumes of fluid that pass through it.

BRIEF DESCRIPTION OF THE DRAWINGS

Other objects and advantages of the invention will become apparent upon reading the following detailed description and upon referring to the drawings in which.

Figure 1:
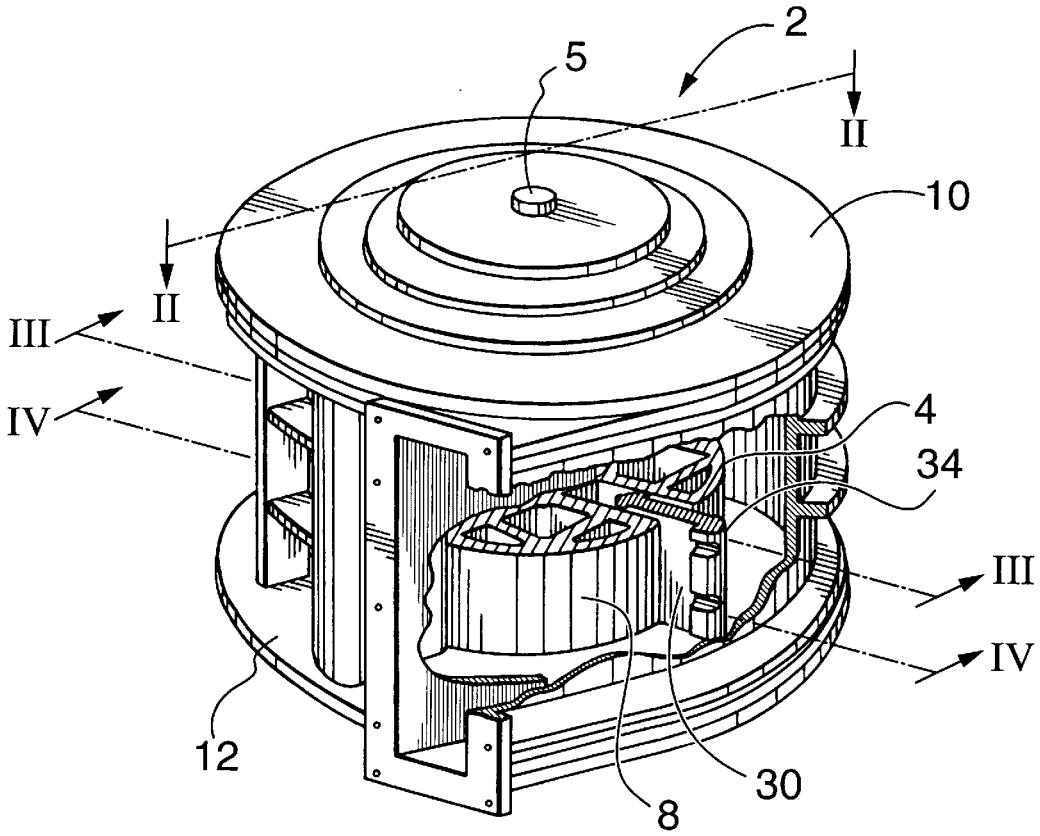
FIG. 1 is a perspective view, in partial section, of a rotor device according to the present invention.
Figure 2:
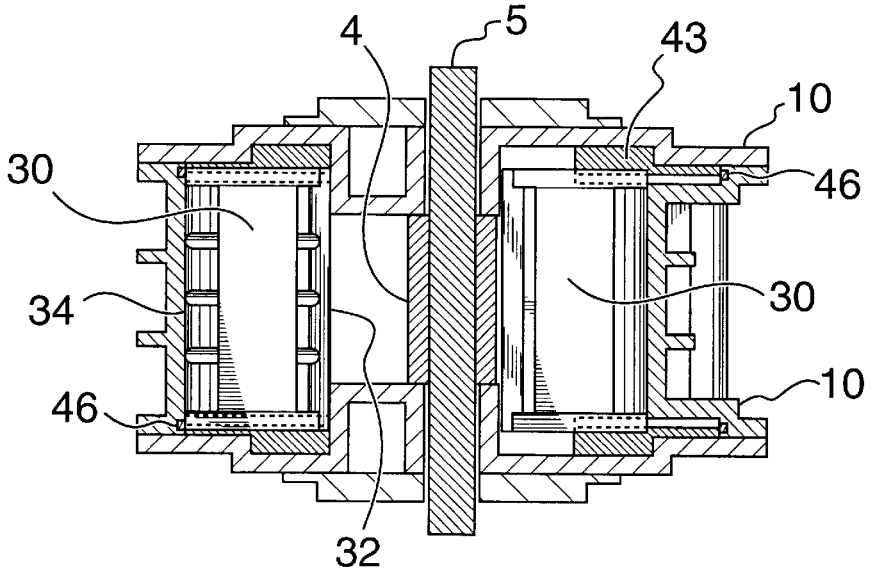
FIG. 2 is an elevational cross-section of the device through line II—II of FIG. 1.
Figure 3:
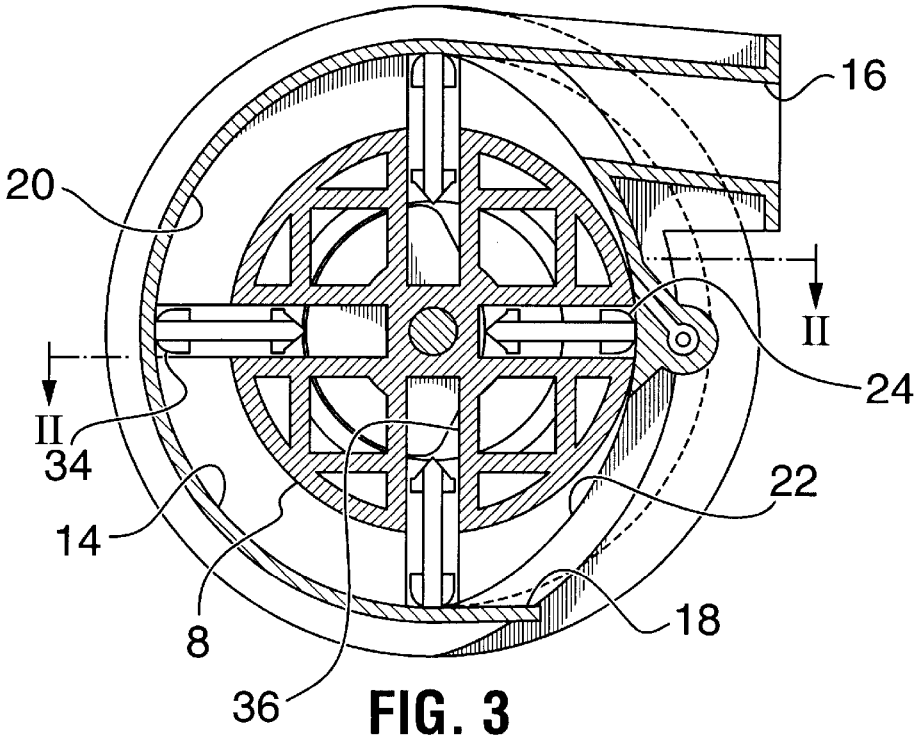
FIGS. 3 and 4 are plan cross sectional views of the device according to the present invention taken along lines III—III and IV—IV respectively in FIG. 1.
Figure 4:
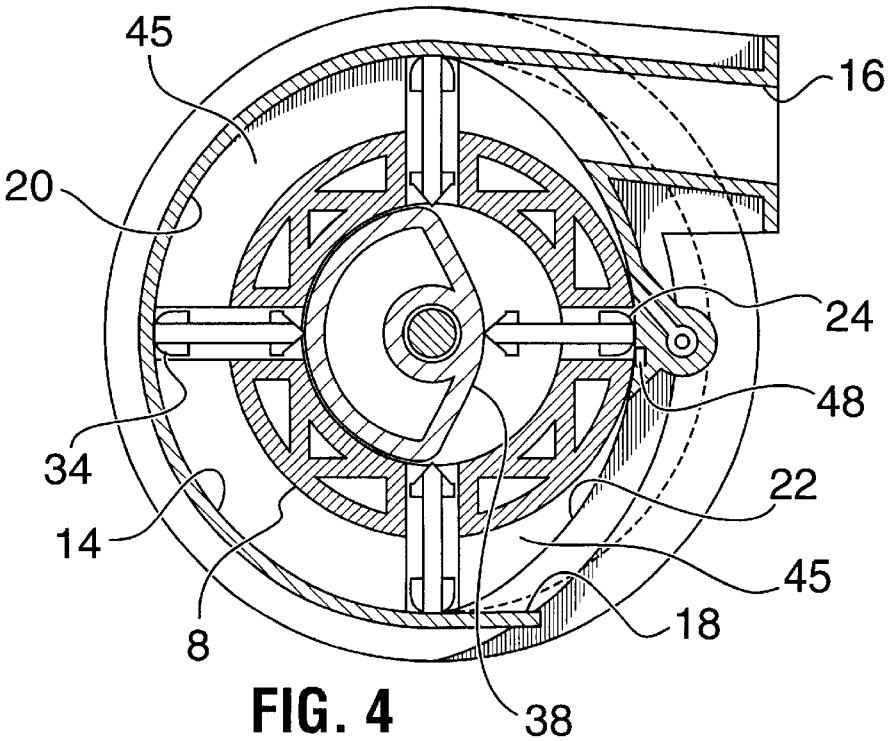

While the invention will be described in connection with examples and embodiments, it will be understood that it is not intended to limit the invention to that embodiment. On the contrary, it is intended to cover alternatives, modifications and equivalents as may be included within the spirit and scope of the invention as defined by the appended claims.

DETAILED DESCRIPTION OF THE INVENTION

In the Figures, similar features have been given similar reference numerals.

Turning to FIGS. 1 to 5, there is shown a rotor device 2 according to the present invention comprising a rotor 4, driven by a shaft 5, having ends 6 and a cylindrical side wall 8. This rotor is encased within a housing 10. Housing 10 is provided with interior end walls 12 confronting the rotor ends 6 and interior side wall 14, with fluid inlet port 16 and fluid outlet port 18 in the side wall communicating with the chamber of housing 10, within which rotor 4 is seated. Housing 10 is provided with a first portion 20 of interior side wall 14 which is cylindrical and curved with constant radius over an angle of about 180°. As be seen in FIG. 3, portion 20 of the interior side wall 14 is spaced a constant distance from corresponding portions of the sidewall 8 of rotor 6. The housing is further provided with a second portion 22 of the interior side wall 14, which continues from the extremities of portion 20, and is formed with a curvature of greater radius than that of portion 20. Side wall 8 of the rotor 6 meets the interior side wall 14 of the housing at a point 24 located approximately midway between inlet port 16 and outlet port 18, on portion 22.

A series of elongated vanes 30, having inner ends 32 and outer ends 34, extend parallel to the axis of rotor 4 and are movable radially with respect to rotor side wall 8 within radial slots 36 provided as illustrated in rotor 4, between extended and retracted positions. Outer ends 34 of vanes 30 are formed somewhat like a mushroom cap, when viewed in cross-section, to give greater strength to the vanes during operation. These outer ends 34 when fully extended maintained a position close to inner wall portion 20 of housing 10. Vanes 30 are equally spaced from adjacent vanes about rotor 4, such that there is always at least one vane positioned between inlet port 16 and outlet port 18. Inward movement of vanes 30 with respect to rotor 4 is achieved by surface portion 22 of side wall 14 acting as a cam surface to bear against outer end 34 of each vane 30 as that vane passes.

Outward movement of vanes 30 is achieved by means of additional cam surfaces 38, one of which is provided on the inner surface of each end wall 12 of housing 10. This feature can best be seen in FIGS. 4 and 5. These cam surfaces 38, are constructed and positioned so as to bear against inner ends 32 of vanes 30 to extend these vanes 30 outwardly when required the vanes are in the vicinity of interior housing side wall portion 20. It will be noted that the distance between facing portions of cam surface 38 and the inner wall 14 of housing 10 is constant (and similar to the length of vanes 30) about the device.

Figure 5:
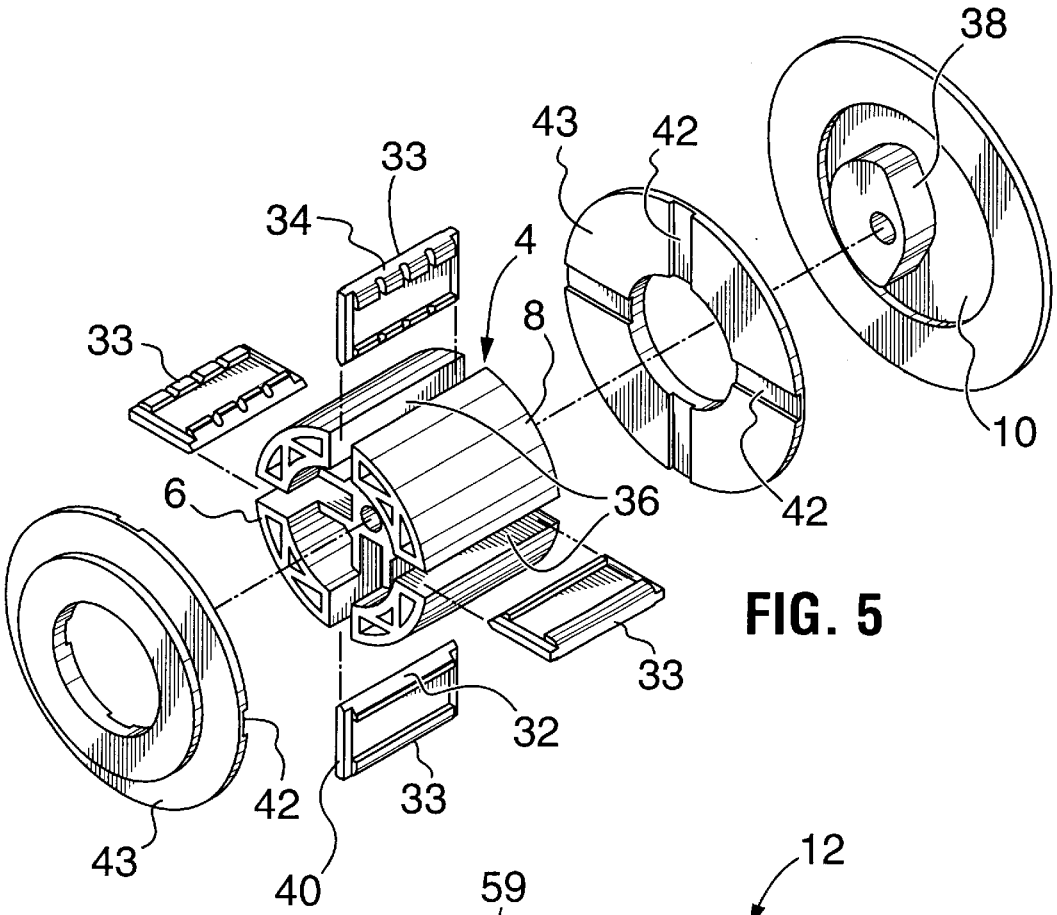
FIG. 5 is an exploded perspective view of the rotor and portions of opposite end walls of the housing of the device according to FIGS. 1 to 4.
Figure 6:
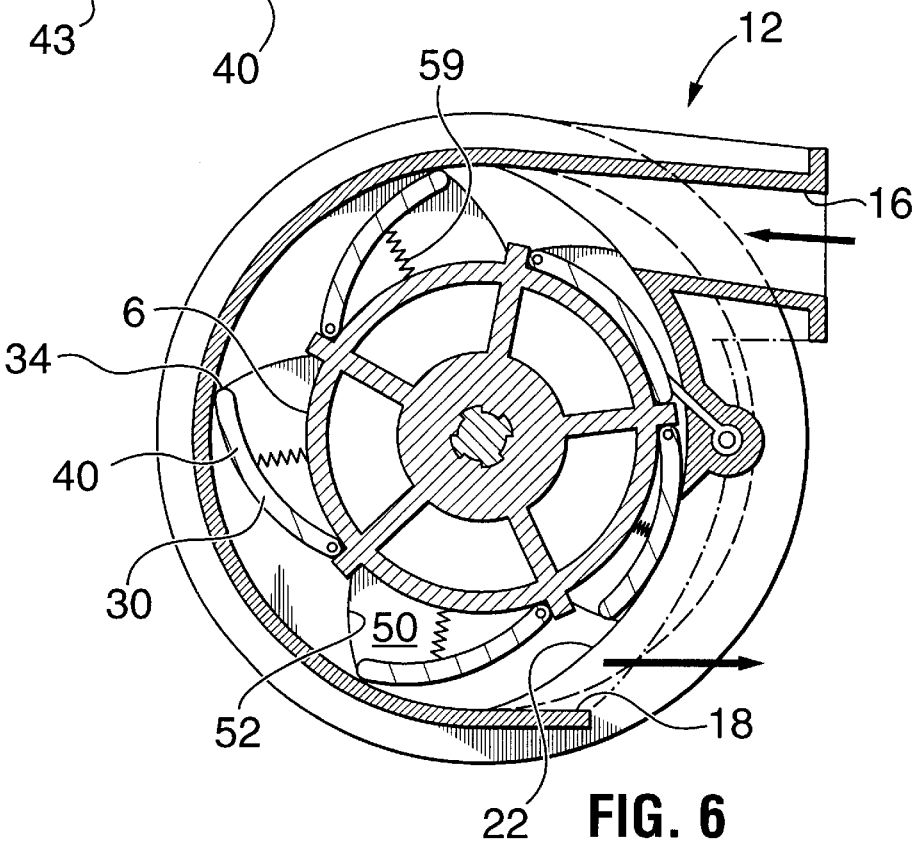
FIG. 6 is a schematic cross-sectional view of a further embodiment of the device according to the present invention.

As can be seen particularly in FIG. 5, the sides of each vane 30 are provided with shoulders 40 which slide in corresponding guide slots 42 in rotor disks 43, which rotor discs rotate with rotor 6 on shaft 5. The outward movement of vanes beyond a point where the ends of the vanes are adjacent portion 20 of the interior side wall of housing may be further obstructed by shoulders of vanes abutting against stops (not illustrated) in rotor body. In this way, vanes are prevented from bearing too heavily on portion 20 of the interior side wall of housing during operation. This shoulder and slot arrangement assists in stabilizing the movement of the vanes during operation of the device and enable the device to withstand significant fluid forces within the housing, during its operation. This arrangement also acts to seal the ends of the vanes from the adjoining chambers, and controls the vane's movement when fully extended so they seat close to the inner wall over 180° of rotor revolution but do not contact it.

In operation, a fluid such as water entering rotor housing 10 at inlet 16 under pressure will turn rotor 6 until the water becomes trapped in a compartment 45 formed between adjacent vanes 30, as well as opposing surfaces of housing 10 and rotor 6, and rotor disk 43. Vanes 30 are fully extended over about one half revolution of the device, urged to that position by cam surfaces 38. When the vane reaches a position immediately before outlet 18, it begins to be urged into withdrawn position within its slot 36 under urging of portion 22 of the side wall 14 of housing 2. Fluid in the appropriate compartment 45 is then allowed to escape through outlet port 18 as lead vane 30 continues past outlet port 18. A fluid seal 46 (FIG. 2) is provided as illustrated, between rotor disks 43 and the interior wall of housing 10.

An appropriate means, such as a sensor 48 may be provided to record the number of rotations of rotor 6, if the device is intended to be used for metering functions.

The device according to the present invention enables an excellent seal between adjacent compartments 45. Since the vanes are supported in both directions, a strong non-binding configuration is achieved. It provides a smooth and efficient operation and enables continuous movement of the rotor in one direction. It is capable of providing more efficient conversion of energy than screw blades or turbines because of the direct application of the force of the incoming fluid on the vanes. It permits the rotor to be under full power under force of the fluid entering the inlet over one half of a revolution.

In the alternative embodiment illustrated in FIG. 5, instead of the vanes 30 being radially movable in slots 42 in rotor 6, these vanes are pivotally attached, as illustrated, to the outer surface of rotor 6. During operation, they pivot between a closed or retracted position, lying adjacent the outer surface of rotor 6, and open or extended position where the outer ends 34 of the vanes 30 lie adjacent inner surface 14 (and portions 20 and 22 thereof) of the housing. In this embodiment, instead of cam surfaces 38, to pivot vanes 30 to open or extended position, the vanes are biased towards open position for example by springs 59 secured to the rotor surface and to a corresponding portion of the under surface of each vane as illustrated. As well, formed in the inner surfaces of rotor disks 43 are pockets 50 having walls 52, to receive and guide the outer ends of vanes 30.

In operation, as vanes 30 are pushed by water entering the housing through inlet port 16 turning rotor 6, outer ends 34 of vanes 3 and entering the second portion 22 of the housing interior side wall are forced inwardly, against the bias of springs 59 as their ends bear against this portion of the side wall, until the vanes are pivoted into retracted position. As the vane ends 34 pass on to inner housing wall portion 20, vanes 30 then open to extended position under urging of springs 59.

Thus there has been provided, in accordance with the invention, a rotor device for converting the energy of a flowing liquid into mechanical energy that fully satisfied the objects, aims and advantages set forth above. While the invention has been described in conjunction with example embodiments thereof, it is evidence that many alternatives, modifications and variations will be apparent to those skilled in the art in light of the foregoing description. Accordingly, it is intended to embrace all such alternatives, modifications and variations a fall within the spirit and broad scope of the appended claims.

What is claimed is:

1. A rotor device for converting the energy of a flowing fluid into mechanical energy which comprises:

a rotor having ends and a cylindrical side wall;

a rotor disc at each end of the rotor to rotate with the rotor;

a housing encasing the rotor, the housing having interior end walls confronting the rotor ends and interior side walls, with fluid inlet and fluid outlet ports in the side walls, a first portion of the interior side wall of the housing being cylindrical and curved with constant radius over an angle of approximately 180°, this portion being spaced a constant distance from corresponding portions of the wall of the rotor, a second portion of the interior side wall of the housing continuing from the extremities of the first portion of the interior side wall and being of curvature of greater radius, the wall of the rotor meeting the interior wall of the housing at a point between inlet and outlet ports about midway on the second portion, the inlet and outlet ports being located in this second portion of the interior side wall of the housing;

two or more vanes extending from end to end in the rotor and having inner and outer ends extending parallel to the axis of the rotor, each vane movable radially inwardly and outwards between retracted and extended positions with respect to the cylindrical side wall of the rotor within slots therein, the vanes having side shoulders which slide in corresponding guide slots in the rotor discs, with outer ends positioned adjacent the inner wall of the housing, the vanes being spaced from adjacent vanes about the rotor such that there is always at least one vane positioned between inlet and outlet ports;

means to move each of vanes radially within its associated slots between an extended position and fully withdrawn position so that the outer extremity of each vane is positioned adjacent a corresponding portion of the inner wall of the housing, the rotor, the housing and the vanes constructed so that, during operation of the device, fluid entering housing drives the rotor, the fluid being carried by the rotor in compartments formed between adjacent vanes and, opposing walls of the housing and rotor, and the rotor itself, until the adjacent vanes encompass the outlet port whereby the fluid is allowed to escape.

2. A device according to claim 1 wherein the means to move the vanes comprises cam surface means bearing against the inner ends of the vanes to extend the vanes, and wherein, to move the vanes inwardly the inner wall of the housing is constructed so as to bear against the outer ends of the vanes to push the vanes from extended position towards withdrawn position, the distance between facing portions on the cam surface and the inner wall of the housing being constant about the device.

3. A device according to claim 2 wherein cam surface means are provided on the housing end walls at both ends of the rotor.

4. A device according to claim 1 adapted for use as a meter, the device being further provided with a sensor to record the number of rotations of the rotor.

5. A device according to claim 1 wherein the vanes are equally spaced about the rotor.

* * * * *